US005294766A

United States Patent [19]

Brotz

[11] Patent Number: 5,294,766

[45] Date of Patent: Mar. 15, 1994

[54] STRUCTURE FOR HIGH-TEMPERATURE MILL ROLLING OF COMPOUNDS

[76] Inventor: Gregory R. Brotz, P.O. Box 1322, Sheboygan, Wis. 53081

[21] Appl. No.: 821,687

[22] Filed: Jan. 16, 1992

Related U.S. Application Data

[63] Continuation-in-part of Ser. No. 437,072, Nov. 15, 1989, Pat. No. 5,101,087.

[51] Int. Cl.[5] ..... H05B 6/14

[52] U.S. Cl. ..... 219/619; 219/469; 219/651; 162/207; 422/146

[58] Field of Search ..... 219/10.492, 10.491, 219/10.51, 10.57, 10.59, 10.61 A, 10.61 R, 10.75, 10.79, 463, 469, 471, 406; 165/89; 100/93 RP; 404/95, 122; 126/410, 270, 438; 355/3 FU; 422/146; 162/207

[56] References Cited

U.S. PATENT DOCUMENTS

| | | | |
|---|---|---|---|
| 3,423,573 | 1/1969 | Richards et al. | 219/10.492 |
| 3,720,808 | 3/1973 | Morrissey | 219/469 |
| 4,350,861 | 9/1982 | Pouillange et al. | 29/10.61 R |
| 4,501,482 | 2/1985 | Stryjewski | 355/3 FU |
| 4,647,744 | 3/1987 | Kitano et al. | 219/10.49 A |
| 4,675,487 | 6/1987 | Verkasalo | 219/10.43 |
| 4,796,049 | 1/1989 | Taniguchi et al. | 355/3 FU |
| 4,819,020 | 4/1989 | Matsushiro et al. | 355/3 FU |
| 4,906,441 | 3/1990 | Flagella | 422/146 |
| 4,948,466 | 8/1990 | Jaakkola | 219/10.492 |
| 5,101,087 | 3/1992 | Brotz | 219/10.492 |

*Primary Examiner*—Bruce A. Reynolds
*Assistant Examiner*—Tu Hoang
*Attorney, Agent, or Firm*—William Nitkin

[57] ABSTRACT

A mill roll having a pair of thick-walled refractory rollers, some having chambers therein the rollers to be heated to incandescent temperatures is disclosed.

4 Claims, 2 Drawing Sheets

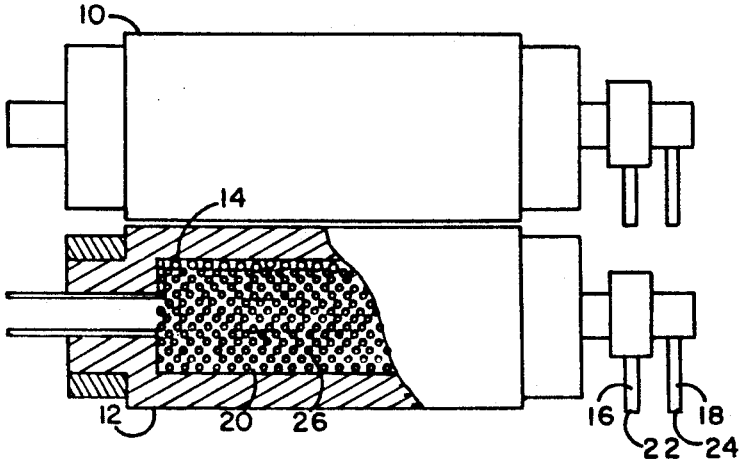
FIG. 1
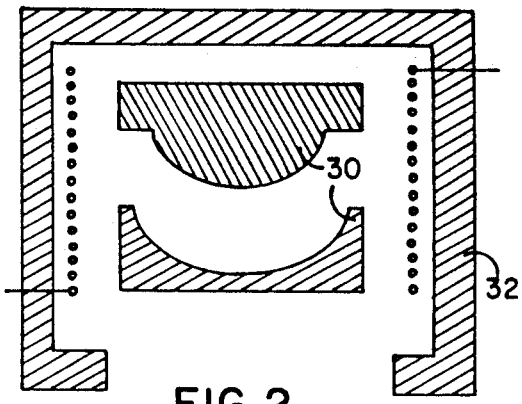
FIG. 2
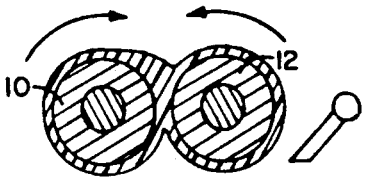
FIG. 3
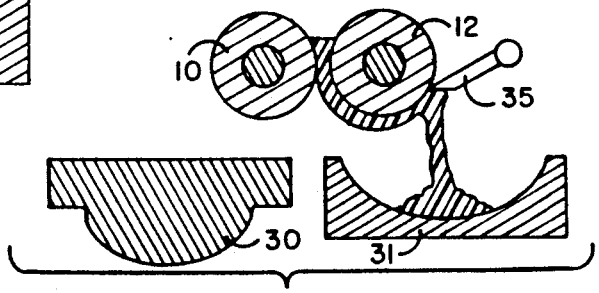
FIG. 4
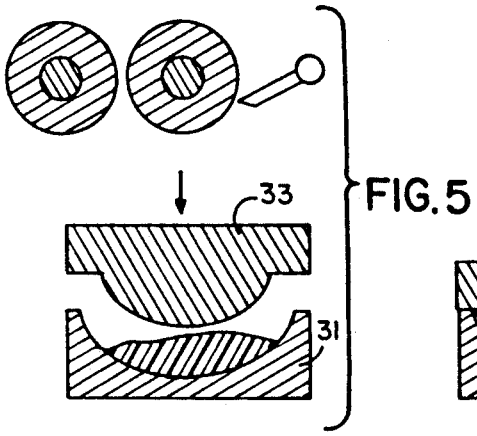
FIG. 5
FIG. 6
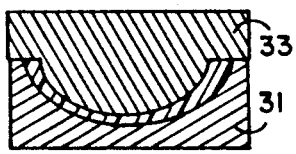
FIG. 7
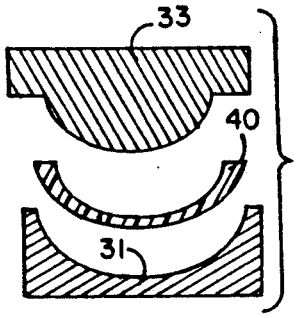

STRUCTURE FOR HIGH-TEMPERATURE MILL ROLLING OF COMPOUNDS

This application is a continuation-in-part of my previous application entitled Structure and Method of High-temperature Rollers Utilizing Fluidized Bed (as amended) filed Nov. 15, 1989, Ser. No. 437,072 now U.S. Pat. No. 5,101,087.

BACKGROUND OF THE INVENTION

1. Field of the Invention

The structure of this invention resides in the area of heated rollers and more particularly relates to a high-temperature roll for the melting and shearing of product.

2. Description of the Prior Art

Conventional roll mills are well known in the art for mixing amounts of materials which are delivered into the nip of the rollers. Many of such roll mills are heated, for example, to melt resins to form a mixture and to blend such mass of materials forming a sheet around the rollers with a buildup of materials forming over the nip where great forces shear the materials together to form an homogenous mass. This type of mixing is highly desirable and is often superior to other forms of material mixing. Sheets that come off such rollers can be cut with a knife or directly deposited into molds.

SUMMARY OF THE INVENTION

It is an object of this invention to provide thick-walled, hollow refractory rollers or solid refractory rollers which heat the material to its very high melting temperature to mix by shearing in the nip therebetween. In one embodiment a pair of such hollow rollers each contain carbide particles forming a bed inside the hollow rollers in which combustion can occur with means to enter fuel and air therein to be mixed and burned inside each roller to achieve high temperatures on the surface of each roller. In a further embodiment such rollers can also be heated with an electrical heating coil contained in the carbon particle bed. It is important to this invention that high melting temperatures be achieved in such rollers as many of the compounds being mixed are glasses or other compounds which require high temperatures in order to maintain such materials in a melted state for combination with other compounds at such high temperatures. Further, such rollers can be operated in a chamber containing various gases and/or vapors as described below.

BRIEF DESCRIPTION OF THE DRAWINGS

FIG. 1 illustrates a top plan view of the refractory rollers of this invention with a section cut away from one of the rollers.

FIG. 2 illustrates the heating of a mold to receive product produced by the roll of this invention.

FIG. 3 illustrates a cross-sectional end view of materials being blended on the roll of this invention.

FIG. 4 illustrates an end view of materials being cut off the roller and delivered to a mold.

FIG. 5 illustrates a cross-section of the mold with liquid material to be molded therein.

FIG. 6 illustrates a cross-section of the mold closed and cooled.

FIG. 7 illustrates a cross-section of the mold opened with formed product removed therefrom.

DESCRIPTION OF THE PREFERRED EMBODIMENT(S)

Figure 8:
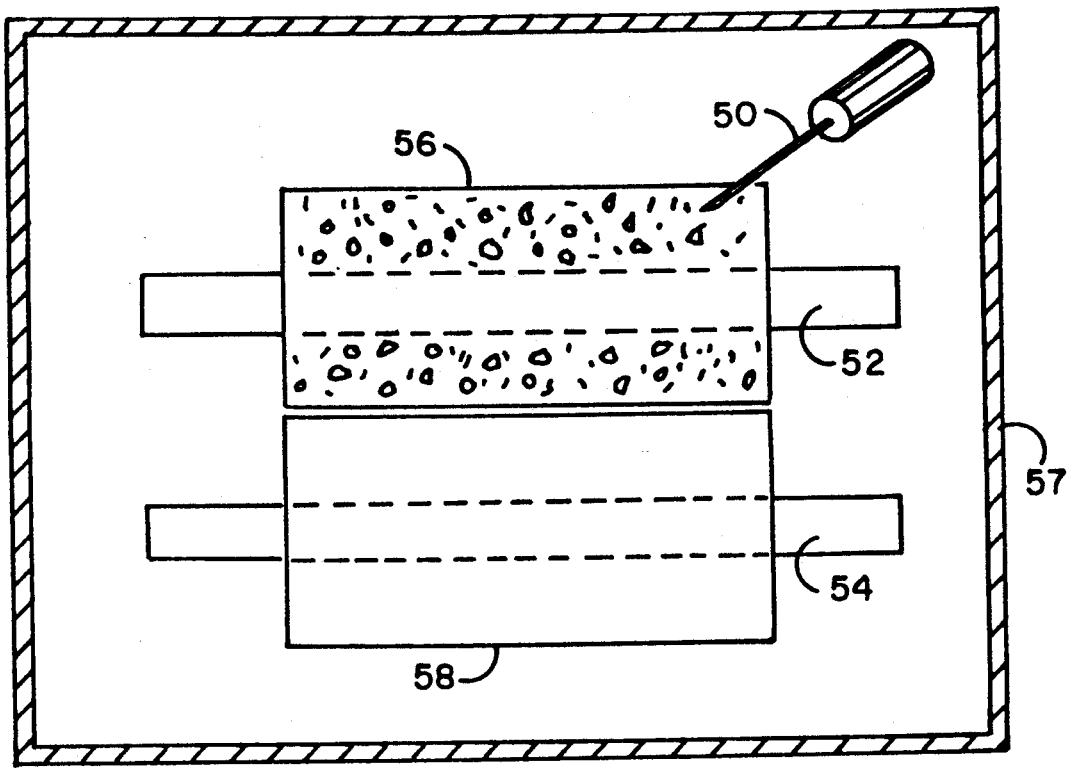
FIG. 8 illustrates a cross-sectional view of solid rollers heated by a heatbeam within a chamber.

FIG. 1 illustrates a top plan view of the refractory roll of this invention showing first roller 10 and second roller 12. The first and second rollers can be made of a thick wall of refractory ceramic material. The rolls can be solid as seen in FIG. 8 or have a chamber 14 therein as seen in FIG. 1. In one embodiment chamber 14 has a plurality of carbide particles 20 therein filling the chamber with spaces defined between the particles to help promote uniform heating when fuel 22 and air 24 are entered through tubes 16 and 18 into fluid bed 26 for ignition therein so that rollers 10 and 12 can reach the high temperatures of incandescence being approximately 1200 degrees C. sufficient to shear and melt the materials being mixed thereon. In an alternate embodiment internal electric induction coils or conventional heat cartridges can be placed within the rollers to heat them to the necessary high temperatures. If a chamber is provided in each roller, the walls must be very thick to provide the necessary strength for the pressure to roll the materials. A ratio of 1:0.5 to 1:0.75 wall thickness outside diameter to the inside diameter of the chamber provides sufficient thickness to the walls for the necessary strength.

Some high-temperature refractory materials for roll construction are listed below:

| Compound | Melting Point |
|---|---|
| CaF | 1330 C. |
| Vycor (96% sio) | 1550 C. |
| Feo | 1560 C. |
| Fused silica | 1710 C. |
| $SiO_2$ | 1710 C. |
| $Al_2O_3$ | 2050 C. |
| $ZrO_2$ | 2700 C. |
| MgO | 2800 C. |
| TiC | 3190 C. |
| Graphite | 3500 C. |
| HfC | 3890 C. |
| TaC | 4730 C. |

These material's melting points are just an indication of the useful operating temperature of these types of rolls. Consideration of reactions occurring between the roll material and the material being rolled has to be made. The physical properties of the materials making up the rolls change as the temperature of the rolls approaches its melting point temperature. But due to the crystalline nature of refractory materials, the physical properties and integrity of the rolls can be maintained at operating temperatures heretofore not reached in the prior art. The usefulness of new materials that can be produced in such roll mills opens unexplored areas in material science.

FIG. 2 illustrates the first step in a process where materials which have been blended and rolled on the high-temperature roll of this invention can be molded. Seen in this view is the pre-heating of mold 30 within oven 32. End views of rollers 10 and 12 are seen in FIG. 3 with the materials being blended and direction of movement therearound. In FIG. 4 the mold is seen with its bottom open with an arm 35 catching the blended materials off one of the rollers and directing it into bottom 31 of the mold which, once it is therein as seen in FIG. 5, top 33 of the mold is placed thereover and mold 30 in FIG. 6 is cooled and top 33 and bottom 31 are then separated as seen in FIG. 7 with the product 40 removed therefrom.

Figure 9:
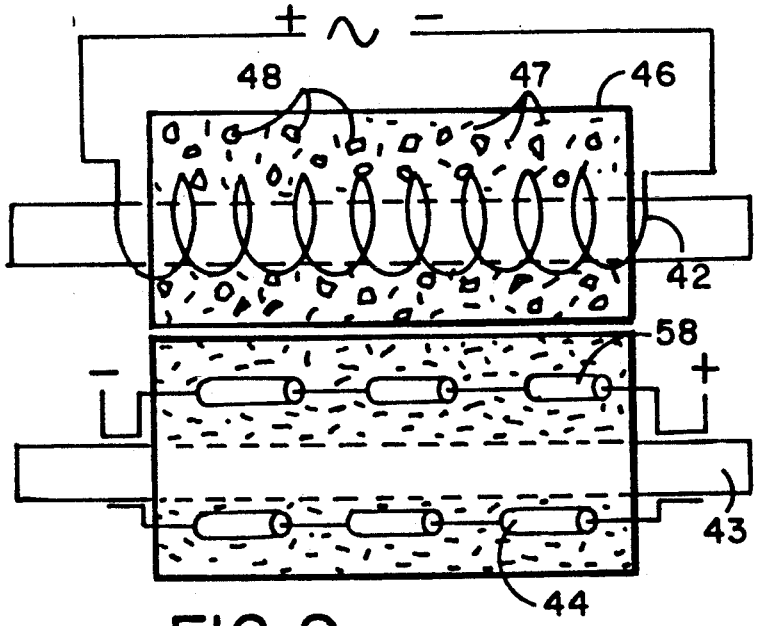
FIG. 9 illustrates solid rollers heated by electrical induction heaters.

If solid rolls are utilized as seen in FIGS. 8 and 9, they can be heated by induction coils such as 42 in roll 46. Some rollers can be made by compressing refractory particles 47 with conductive particles 48 and sintering such particles together as seen in roll 44 in FIG. 9. Conductive particles 48 can be incorporated into the particle matrix of the refractory materials to be heated by electrical induction heaters. FIG. 8 shows heating of rolls 56 and 58 by heat beam 50 which can be from a laser or other high heat source such as concentrated infrared beams aimed to impinge directly on a portion of the sidewalls of the rollers or roller journals 52 and 54 to conduct heat to the rollers. The heat beam can be scanned over the rollers. An example of such a hot laser can be a $CO_2$ (carbon dioxide) gas laser or a NdYag (neodymium yttrium aluminum garnet) solid state laser. In another embodiment heat can be added to the rolls by directing the heat beam directly on the material to be mixed. The heat beam type heat source can be utilized also in addition to the other roll heating methods mentioned above. FIG. 8 also illustrates chamber 57 which can have oxygen removed therefrom which oxygen in some cases can have an adverse reaction with the compounds being made. Chamber 57 can be provided with an inert atmosphere or even with a desired reactant gas or vapor.

Many products can be made on the heated rollers of this invention such as, for example, molten glass with triazines such as melem, melan or melon in a mixture and aluminum-rich glass which contains a high percentage of aluminum to reduce its brittleness. These glasses also can contain iron and serrium within their alloys as well as in some cases nickel and yttrium. Such aluminum-rich glass which can be mixed in this type of high-temperature roll rather than melt-spinning is useful as a lightweight construction material in the aerospace field because they crystallize at a relatively high temperature. Fibers, such as ceramic, tungsten or graphite fibers, can also be sheared into the melt on rollers. A larger nip gap adjustment would have to be made to minimize fiber degradation.

Although the present invention has been described with reference to particular embodiments, it will be apparent to those skilled in the art that variations and modifications can be substituted therefor without departing from the principles and spirit of the invention.

I claim:

1. A mill roll comprising:

a pair of rollers made of refractory ceramic material, said rollers having walls having a thickness;

a hollow chamber defined in at least one of said rollers, said walls being in the range of wall thickness: diameter of said hollow chamber in the range of 1:0.5 to 1:0.75; and means to heat said rollers to incandescent temperatures of at least 1200 degrees C.

2. The mill roll of claim 1 wherein said rollers further include conductive particles embedded in said refractory ceramic material.

3. The mill roll of claim 1 further including a plurality of carbide particles in said hollow chamber.

4. The mill roll of claim 2 wherein said mill roll is operated in an atmospherically controlled chamber.

* * * * *